US010478851B2

(12) United States Patent
Ettlin

(10) Patent No.: US 10,478,851 B2
(45) Date of Patent: Nov. 19, 2019

(54) APPLICATOR FOR A FLUID INGREDIENT AND METHOD OF ACTIVATING AN APPLICATOR

(71) Applicant: Sulzer Mixpac AG, Haag (CH)

(72) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 60 days.

(21) Appl. No.: 15/577,479

(22) PCT Filed: May 30, 2016

(86) PCT No.: PCT/EP2016/062189
§ 371 (c)(1),
(2) Date: Nov. 28, 2017

(87) PCT Pub. No.: WO2016/193224
PCT Pub. Date: Dec. 8, 2016

(65) Prior Publication Data

US 2018/0141078 A1 May 24, 2018

(30) Foreign Application Priority Data

May 29, 2015 (EP) ..... 15169845

(51) Int. Cl.
*B43K 5/14* (2006.01)
*B05C 17/00* (2006.01)
*B65D 83/00* (2006.01)

(52) U.S. Cl.
CPC ..... *B05C 17/003* (2013.01); *B65D 83/0027* (2013.01); *B65D 2101/0015* (2013.01)

(58) Field of Classification Search
CPC . B05C 17/002; B05C 17/003; B65D 83/0027; B65D 2101/0015; A61M 35/003
(Continued)

(56) References Cited

U.S. PATENT DOCUMENTS 5,308,180 A 5/1994 Pournoor et al.
6,321,942 B1 11/2001 Krampen et al.
(Continued)

FOREIGN PATENT DOCUMENTS

WO 2014083570 A1 6/2014

OTHER PUBLICATIONS

International Search Report dated Sep. 6, 2016 in corresponding International Application No. PCT/EP2016/062189, filed May 30, 2016.

(Continued)

*Primary Examiner* — Jennifer C Chiang
(74) *Attorney, Agent, or Firm* — Global IP Counselors, LLP

(57) ABSTRACT

An applicator for a fluid ingredient includes at least one storage chamber, at least one first predetermined breaking point or line configured in or at the storage chamber, and an actuation mechanism. The storage chamber has an outlet end with an initially sealed outlet via which a fluid ingredient can be output. The actuation mechanism is arranged at the storage chamber, and has at least one activation part capable of being displaced relative to the outlet end and by which at least one part or section of the storage chamber is capable of being axially displaced to activate the at least one first predetermined breaking point or line, on an activation of the applicator.

17 Claims, 3 Drawing Sheets

(58) Field of Classification Search
USPC ..... 401/133, 183
See application file for complete search history.

(56) References Cited

U.S. PATENT DOCUMENTS

| | | | | |
|---|---|---|---|---|
| 6,916,133 | B2 * | 7/2005 | Hoang | A61M 35/006 401/132 |
| 7,094,250 | B2 | 8/2006 | Stenton | |
| 7,727,175 | B2 * | 6/2010 | Voegele | A61F 15/005 401/132 |
| 7,976,234 | B2 | 7/2011 | May | |
| 8,550,737 | B2 | 10/2013 | Ruiz, Sr. et al. | |
| 9,427,560 | B2 * | 8/2016 | Burstein | A61M 35/003 |
| 9,498,045 | B2 * | 11/2016 | Hartstock-Martin | A46B 11/0003 |
| 9,610,410 | B2 * | 4/2017 | Joedicke | A61M 5/2448 |
| 2011/0056984 | A1 | 3/2011 | Cheetham | |

OTHER PUBLICATIONS

Extended European Search Report dated Jan. 11, 2016 in corresponding European Patent Application No. 15169845.3, filed May 29, 2015.

* cited by examiner

APPLICATOR FOR A FLUID INGREDIENT AND METHOD OF ACTIVATING AN APPLICATOR

CROSS-REFERENCE TO RELATED APPLICATION

This application is a U.S. National Phase application of International Application No. PCT/EP2016/062189, filed May 30, 2016, which claims priority to European Application No. 15169845.3, filed May 29, 2015, the contents of which are hereby incorporated herein by reference.

BACKGROUND

Field of the Invention

The invention relates to an applicator for a fluid ingredient, as well as to a method of activating an applicator.

Background of the Invention

Applicators are known in the prior art that permit the dispensing of fluid ingredients, such as adhesives or other substances. The substances can, for example, be used in medical applications for wound care or in DIY applications for sealing and/or bonding purposes. Common to at least those two types of applications is the use of cyanoacrylate (CA). CA is a fast setting adhesive particularly when it is in contact with water. Humidity in air can also cause the CA to set. For this reason the CA has to be stored in a sealed air tight container.

Some applications therefore use glass ampules as a storage container. Glass ampules provide an air tight seal. However, in use a part of the glass ampule is broken off, such that the possibility exists that miniscule glass splinters remain in the CA, which would also be dispensed at the position of application of the CA. This should in particular be avoided with regard to medical applications. Moreover, a targeted dispensing from a glass ampule is not generally possible via the broken off end.

Other applications use plastic applicators in which the CA is sealed in a compartment which is activated through the application of pressure on a part of the applicator. However, due to the configuration of the prior art applicators the outlets thereof can easily become clogged due to e.g. the fast setting time of the CA and/or parts of the applicator breaking off during the activation thereof. Moreover, dispensing from the prior art cartridges can be laborious due to the construction of the seal that has to be broken. It is common to both glass and plastic applicators that the CA tends to remain in the storage container.

SUMMARY

In view of the foregoing it is an object of the present invention to provide an applicator having improved dispensing capabilities. It is a further object of the invention to reduce the amount of fluid ingredient which remains in the storage container. Yet a further object of the invention is to provide an applicator that makes available an air tight seal for a fluid ingredient stored therein.

These objects are satisfied by an applicator described herein.

In accordance with the invention an applicator for a fluid ingredient comprises at least one storage chamber, the storage chamber having an outlet end with an initially sealed outlet via which a fluid ingredient can be output;

at least one first predetermined breaking point or line configured in or at the storage chamber, and an actuation mechanism arranged at the storage chamber, the actuation mechanism having at least one activation part that can be displaced relative to the outlet end and by means of which at least one part or section of the storage chamber can be axially displaced, preferably in the direction of the outlet, in order to activate the at least one first predetermined breaking point or line, on an activation of the applicator.

The actuation mechanism is advantageously provided to cause a controlled breakage of the at least one first predetermined breaking point or line on the predefined displacement of the at least one activation part relative to the storage chamber and to thereby make available the fluid ingredient stored in the storage chamber.

Advantageously the at least one first predetermined breaking point or line seals off the outlet in a non-activated state to ensure the air-tight seal during a storage of the fluid ingredient.

It should be noted that loose parts of the at least one first predetermined breaking point or line can be prevented from clogging up the outlet of the storage chamber by the controlled breakage of the at least one first predetermined breaking point or line. Thereby the dispensing of the fluid ingredient from the applicator can be facilitated.

In this connection it should also be noted that the at least one first predetermined breaking point or line is preferably arranged at the outlet end of the storage chamber. If more than one storage chamber is used for a multicomponent fluid ingredient then at least two predetermined breaking points or lines can be provided, namely at least one for each storage chamber.

It should further be noted that the fluid ingredient can be a liquid ingredient or a gel-like ingredient, i.e. an ingredient that is capable of flowing at least a certain distance after having been dispensed or output.

Moreover, the fluid ingredient can be subjected to a pressure facilitating the dispensing of the fluid ingredient out of the storage chamber through axial displacement of the at least one activation part relative to the storage chamber, in particular in the direction of the outlet. Thereby an amount of fluid ingredient remaining in the storage chamber can be reduced, reducing the cost of manufacture of such filled applicators.

Preferably the actuation mechanism is actuated by at least one of a rotation of the at least one activation part and an axial movement of the at least one activation part.

A rotation and/or an axial displacement of the at least one activation part is possible in order to translate movement of the at least one activation part into an axial displacement of at least one part or section of the storage chamber.

Advantageously the actuation mechanism comprises a first threaded section that is arranged in, i.e. operatively coupled to, a second threaded section configured in the storage chamber in order to bring about both the rotation and the axial movement of the at least one activation part on an activation of the applicator. A threaded connection is an advantageous kind of connection to bring about both the rotational and axial displacement of the at least one part or section of the storage chamber in the direction of the outlet.

Preferably the actuation mechanism further has a plunger, in particular formed by a web, with the plunger being provided to transmit a force induced by the at least one activation part to the at least one part or section of the storage chamber during the axial displacement thereof, on an activation of the applicator. The plunger can be integrally formed with the activation part.

Such a plunger can thus not only advantageously be used to effect the axial displacement of the at least one part or section of the storage chamber in the direction of the outlet, but can also be used to transmit a force introduced by the actuation mechanism between different components of the applicator during an application thereof.

The applicator is preferably activated at an activation end of the storage chamber, the activation end being axially spaced apart from the outlet end. Thereby the activation of the applicator can take place via an end that is remote from the outlet end of the applicator, so that the outlet end can be designed, in particular with respect to its dispensing capabilities to facilitate a dispensing via the outlet.

It is preferred if the storage chamber comprises at least two parts, an outlet part comprising the outlet and a sealing part inserted into the outlet part via an activation end, with an end of the sealing part being remote from the outlet end and sealing off the storage chamber so as to provide an airtight storage chamber.

Producing the storage chamber from two parts enables these to be connected in an airtight manner once the storage chamber is filled, as the storage chamber can be evacuated and the two components can be joined in a sealing manner during or after the filling process.

Preferably components of the applicator, such as the at least two parts of the storage chamber or those of the actuation mechanism are produced by an injection molded process. Thereby the individual components can be formed from such materials as COC or PET. These materials are particularly suitable for the storage of adhesives or other substances.

In this connection it should be noted that, on activation of the applicator, at least one section of the outlet part and/or of the sealing part is axially displaced. The at least one section of the outlet part and/or of the sealing part then being displaced relative to at least some of the other sections of the outlet part and/or of the sealing part.

Advantageously the second threaded section is configured in the outlet part. Thus, the applicator can be constructed with as few parts as possible, making its design simpler and thereby making the applicator more simple to manufacture.

It is preferred if the storage chamber is formed between an inner surface of the outlet part and an outer surface of the sealing part, with the outer surface of the sealing part preferably extending within the outlet part such that the storage chamber is of tube-like design and is formed around the sealing part that can likewise be of tube-like design.

Forming the sealing part within the outlet part such that the storage chamber is formed there between is advantageous from a construction point of view.

Advantageously the plunger is received within the sealing part via the activation end, in particular within a channel formed within an inner surface of the sealing part, i.e. within the sealing part of tube like design, with the channel preferably being formed within the storage chamber.

By designing the sealing part such that it surrounds the plunger and this in turn being surrounded by the storage chamber which is housed by the outlet part, permits the applicator to be designed in a simple manner. Moreover, the plunger can thereby be guided within the storage chamber to effectively activate the at least one pre-determined breaking point or line and apply a greater force to ensure an improved activation of the applicator.

In this connection it is advantageous if the plunger is configured to engage the sealing part and thereby indirectly also the outlet part in a distal region in which the sealing part and the outlet part contact one another, to preferably form a distal boundary of the storage chamber, in order to activate the at least one first predetermined breaking point or line on an activation of the applicator.

Providing the distal region in which the sealing part and the outlet part contact one another, on the one hand, ensures a seal in the storage state of the applicator. On the other hand, when the applicator is activated by the plunger that is e.g. guided within the sealing part to entrain the sealing part, this also ensures that the part of the outlet part adjacent to the at least one first predetermined breaking point or line is engaged on an activation of the applicator. Thereby the activation of the at least one first predetermined breaking point or line is ensured.

Preferably the distal region comprises a nose formed in the outlet part and the sealing part engages the nose of the outlet part.

The nose provides an advantageous point of application of the force induced via the actuation mechanism and thus via the plunger to bring about an activation of the at least one first predetermined breaking point or line on an activation of the applicator.

Preferably the applicator further comprises a venting system.

A venting system can advantageously be used to regulate the flow of gas to and from the storage chamber when this is filled with the fluid ingredient. For example, the venting system can be used to supply gas to the storage chamber once the applicator has been activated. The gas flow into the storage chamber can advantageously aid the output of the fluid ingredient from the storage chamber via the outlet.

Advantageously the plunger is part of a venting system. In this way the number of components of the applicator can be reduced, the applicator can be simplified and thereby the demand in effort and cost for the manufacture of the applicator can be reduced. In this connection it should be noted that the plunger is operatively connected to the venting system which in turn is operatively connected to the activation part of the applicator so that on the displacement of the activation part in the direction of the outlet, both the venting system and the plunger are likewise displaced in the direction of the outlet.

In this connection it is advantageous when the sealing part is configured for the accommodation of at least a part of the venting system, preferably of at least a part of the plunger.

In this way the parts of the applicator can be configured with as few parts as possible which reduces the size of the applicator and thus aids the dispensing from it. Preferably a venting channel of the venting system is arranged within the storage chamber, in particular in the sealing part of the storage chamber. This arrangement is compact. Moreover, the provision of a venting channel enables a dedicated gas flow into the storage chamber. Advantageously, the venting system comprises at least one venting passage connecting the venting channel to the inside of the activation part and/or to the environment.

The venting channel is preferably circular and arranged extending along at least a part of the longitudinal axis of the applicator. In this connection it is preferred if the at least one storage chamber of the applicator has a cylindrical outer shape and the venting channel is arranged therein and has also at least in part an at least substantially cylindrical design. Furthermore, the venting channel is preferably guided within walls of the storage chamber adjacent to the venting channel.

Advantageously the venting system comprises a valve via which a flow of gas into the storage chamber, in particular via the sealing part, is controlled.

The valve is installed in order to prevent negative pressure from building up in the storage chamber. A build-up of negative pressure in the storage chamber would hinder the dispensing of the fluid ingredient from the storage chamber. The valve can be a check valve, a piston valve or a poppet valve.

Advantageously at least one second predetermined breaking point or line is arranged between the venting system and the storage chamber.

Arranging the at least one second predetermined breaking point or line between the venting system and the storage chamber enables the gas flow to be induced at a location remote from the outlet and thereby facilitates the urging of fluid ingredient from the storage chamber via the outlet.

Preferably the at least one first and/or second predetermined breaking point or line comprises a slot after a breaking thereof through which air can flow into the storage chamber to prevent a build-up of negative pressure in the storage chamber. Thus, the at least one second predetermined breaking point or line is preferably arranged to facilitate the activation of the venting system.

It is preferred if the storage chamber has excessive volume and is formed such that the fluid ingredient cannot flow into the venting channel via the at least one second predetermined breaking point or line, in particular the slot, remaining after activation of the applicator. An excessive volume is a volume that is deliberately selected larger than the volume actually required to store a component therein. In the present case a fluid ingredient is e.g. only stored in a distal part of the storage chamber, whereas no fluid ingredient is present in a proximal part of the storage chamber. The proximal part of the storage chamber can be filled with a gas or air and it is this space in which a negative pressure could build-up if no venting system were present.

Advantageously the at least one second predetermined breaking point or line is arranged between the sealing part and walls of the passage of the venting system.

A preferred design of the applicator comprises a first and a second predetermined breaking point or line. In this connection the actuation mechanism is then provided to cause a controlled breakage of the first and the second predetermined breaking points or lines on the predefined displacement of the said at least one activation part.

More preferably the actuation mechanism comprises a first threaded section that is arranged in a second threaded section configured in the storage chamber. A threaded section advantageously permits a controlled rotational and axial shift of the activation part relative to the storage chamber.

The first threaded section is in particular configured at the activation part and the second threaded section cooperating with the first threaded section is configured in the outlet part of the storage chamber.

Preferably the actuation mechanism comprises the venting system and the venting system is displaced within the storage chamber on an activation of the applicator. This can be achieved, for example if the venting system is attached to or integrated into the actuation mechanism. In particular on use of threaded components the venting system can then be linearly displaced relative to the storage chamber on a rotation of the actuation mechanism.

Advantageously, the actuation mechanism axially displaces the venting system and activates at least the first and second predetermined breaking points or lines, on the activation of the applicator, with the at least one first predetermined breaking point or line being configured in or at the outlet part and the at least one second predetermined breaking point or line being arranged in or at the sealing part.

It should be noted that the sealing part can, for example, engage a nose of the outlet part at the outlet end. The section of the outlet part having the nose can then be axially displaced on an application of the applicator relative to the outer wall of the outlet part after the breaking of the first predetermined braking point or line.

In this connection it should be noted that the section of the sealing part engaging the nose of the outlet part is axially displaced relative to a section of the sealing part arranged at the application end on an activation of the applicator after the breaking of the second predetermined braking point or line.

It is preferable if the section of the outlet part and/or the section of the sealing part axially displaced on an activation of the applicator is/are displaced at least substantially the same distance as the venting system is displaced.

Thereby the displacement distance of the parts can be predefined in order to ensure a successful activation of the at least one first and/or second predetermined breaking point or line.

It is preferred if the section of the outlet part comprising the nose is arranged axially within a wall section of the outlet end, preferably with at least one first predetermined breaking point or line forming a boundary between the section of the outlet part comprising the nose and the wall section of the outlet end.

Advantageously a nose engaging section of the sealing part is arranged axially downstream of a sealing end section of the sealing part, preferably with at least one second predetermined breaking point or line forming a boundary between the nose engaging section of the sealing part and a sealing end section of the sealing part.

It is preferred if the applicator further comprises catching elements that retain parts of at least one of the first and/or second predetermined breaking point or line after activation of the applicator.

The catching elements are designed to preferably retain all of the parts of at least one of the first and second predetermined breaking points or lines after activation of the applicator, preferably of all of the first and second predetermined breaking points or lines.

In this connection it should be noted that the catching element can be a film like hinge or any other suitable element that can successfully be employed to retain the parts of the first and/or second predetermined breaking points or lines.

The applicator advantageously further comprises an application compartment adjacent to the storage chamber and separate from the storage chamber in a storage state of the applicator.

In this connection it should be noted that the storage state of the applicator is the state in which the applicator has not yet been activated and is stored, e.g. in its packaging, prior to use. This storage state can be prior to or after the filling with the fluid ingredient, but a state before a fluid ingredient is output from an activated applicator.

Thereby the fluid ingredient can be dispensed from the storage chamber into an application specific compartment that enables an application specific and targeted dispensing of the fluid ingredient from the applicator.

The wall of the application compartment is preferably flexible to control a dispensing action by applying a pressure on the walls of the application compartment. Such a design of an applicator can beneficially be used when adhesives are stored in the storage chamber as the dosage of the fluid ingredient can then be effected through the application of pressure at the flexible walls of the application department.

In an alternative design of the applicator the application compartment has moveable, in particular rotationally and/or axially moveable parts that effect an output of the fluid ingredient from the applicator.

This sort of design enables the use of lipstick like applicators if, e.g. a lip balm or a lipstick is stored in the storage chamber.

It should be noted that the storage chamber is a chamber in which the fluid ingredient can be stored for a period of weeks, months or even years in order to preserve the fluid ingredient from external influences such as air or humidity.

It should further be noted that the application compartment is a compartment in which the fluid ingredient is stored for a significantly shorter period of time in comparison to the storage chamber and the substances present in the application compartment are subjected to external influences.

Advantageously at least one first predetermined breaking point or line is arranged between the application compartment and the storage chamber. Thereby the fluid ingredient can be stored in an airtight chamber preserving the shelf life of the fluid ingredient and only on activation of the applicator are the substances present therein made available in the application department. The substances then have a significantly reduced shelf-life.

Preferably the applicator comprises a dispensing aid at a dispensing end of the applicator. Such a dispensing aid facilitates the discharge of fluid ingredient from the applicator to its position of application.

The dispensing aid can, for example, be a porous application tip, a sponge-like applicator, or a specifically shaped outlet that urges the fluid ingredient out of the applicator. An example of a porous application tip is a made from a rigid porous material such as is supplied by Porex, this is a hydrophobe base material having pores with a size of 25-50 μm.

The dispensing end of the applicator is preferably arranged at the end of the application compartment—preferably axially—remote from the outlet end of the storage chamber.

In a preferred embodiment the applicator further comprises a fluid ingredient stored in the at least one storage chamber. The fluid ingredient stored in the applicator can be a substance, such as cyanoacrylate (CA).

In an aspect of the present invention this relates to the use of an applicator in accordance with the invention in the treatment of a patient. In particular to the use of the applicator in medical applications.

During the medical application e.g. CA can be applied to wounds or to cuts respectively of a patient in order to seal the wounds or cuts so as to achieve an improved healing thereof.

In a further aspect the present invention relates to a method of activating an applicator of the kind described herein that is filed with a fluid ingredient, the method comprising the steps of:

displacing the at least one activation part relative to the dispensing end; and thereby breaking at least one first and/or second predetermined breaking point through an axial displacement of at least a part of the storage chamber.

The method in accordance with the invention can be adapted in a similar manner as the applicator described in the foregoing.

BRIEF DESCRIPTION OF THE DRAWINGS

The invention will be explained in more detail hereinafter with reference to the drawings.

DETAILED DESCRIPTION OF THE EMBODIMENTS

Figure 1:
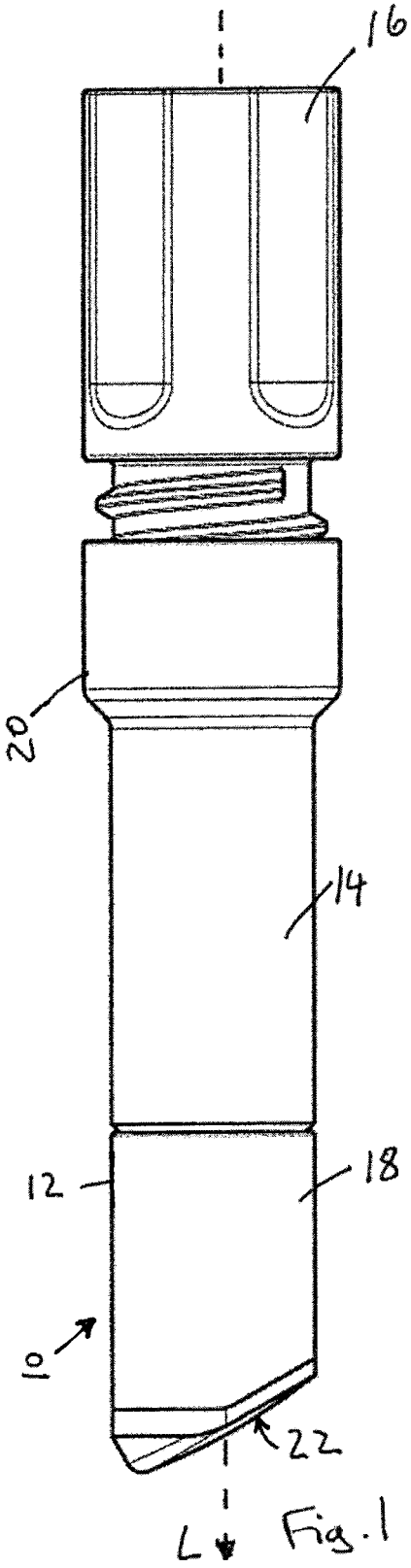
FIG. 1 is a lipstick type applicator.

In the following the same reference numerals will be used for parts having the same or equivalent function. Any statements made having regard to the direction of a component are made relative to the position shown in the drawing and can naturally vary in the actual position of application.

FIG. 1 shows a lipstick type applicator 10. The lipstick type applicator 10 has an application compartment 12, a storage chamber 14 for storage of a fluid ingredient (not shown) and an actuation mechanism 16. The application compartment 12 is covered by a cap 18. The application compartment 12 is designed as a swivel-up tube as is common for lipstick applicators 10. Through a rotation of a wall 20 of the application compartment 12 relative to the storage chamber 14 a fluid ingredient 33 (see FIG. 3) contained in the application compartment 12 can be axially displaced along the longitudinal axis L towards a dispensing end 22 of the applicator 10.

Figure 2:
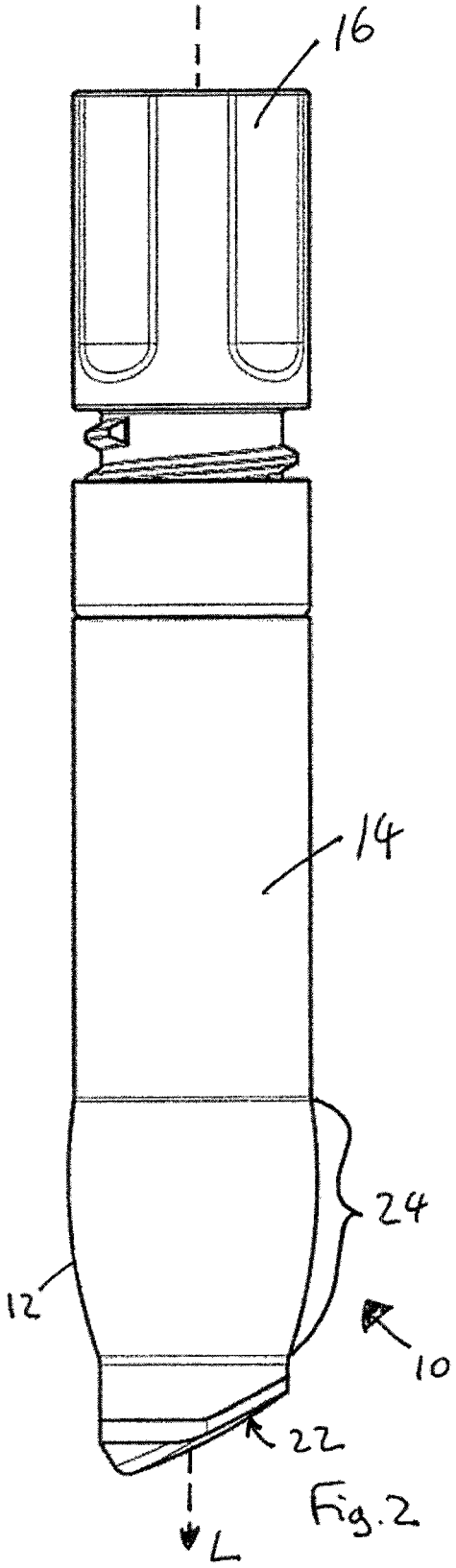
FIG. 2 is a flexible wall type applicator.

FIG. 2 shows a flexible wall type applicator 10. In this example of an applicator 10 the application compartment 12 has a flexible wall section 24 that can be squeezed. By squeezing the flexible wall section 24 the fluid ingredient 33 present in the application compartment 12 can be dispensed via the dispensing end 22 of the applicator 10.

Figure 3:
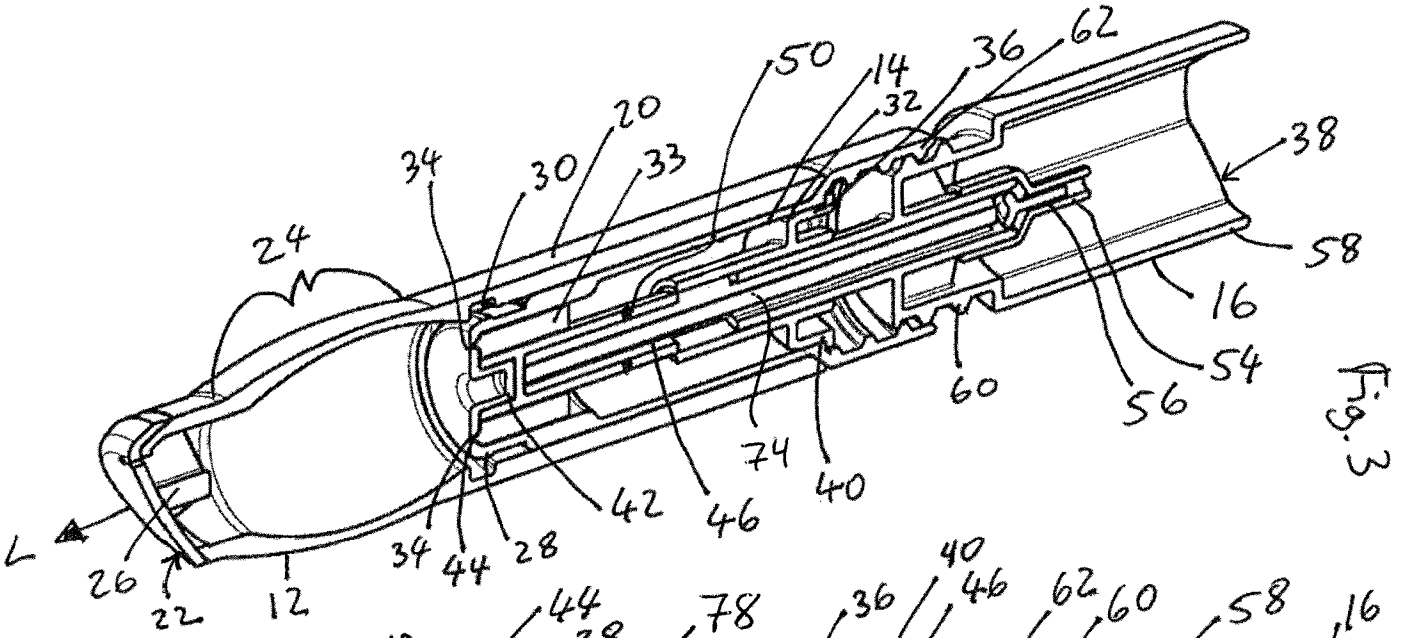
FIG. 3 is a schematic section through the applicator of FIG. 2.

FIG. 3 shows a section through the applicator 10 of FIG. 2. The dispensing end 22 has a dispensing outlet 26 provided therein for the dispensing of the fluid ingredient 33 from the application compartment 12. The dispensing outlet 26 is formed as a simple passage extending from the interior of the application compartment 12 through the beveled dispensing end 22 of the application compartment 12. The beveled shape is selected such that on a dispensing of a fluid ingredient this can be uniformly dispensed from the applicator 10.

The application compartment 12 has an at least sectionally flexible outer wall 24 extending between the dispensing outlet 26 and the storage chamber 14. Moreover, a part of the wall 20 of the application compartment 12 receives the storage chamber 14. For this purpose the part of the wall 20 is formed as a sleeve at its end remote from the dispensing end 22. The storage chamber 14 is simply inserted into this sleeve and has an annular projection 28 that engages a groove 30 present in the sleeve in order to connect the storage chamber 14 to the application compartment 12.

The storage chamber 14 itself is composed of two parts an outlet part 32 comprising an initially sealed outlet 34 and a sealing part 36 inserted into the outlet part 32 via an activation end 38, with an end 40 of the sealing part 36 being remote from the outlet 34 and sealing off the storage chamber 14 so as to provide an airtight storage chamber 14.

The outlet part 32 has a nose 42 present therein, with the nose 42 being adjacent to the sealing part 36. Adjacent to the nose 42 is a first predetermined breaking line 44 which annularly surrounds the nose 42. On the activation of the applicator 10 a venting channel 46 of a venting system 54 at least partly extends within the sealing part 36. The venting system 54 comprises a web 74 acting as a plunger which following an activation of the activator 10 displaces the sealing part 36 axially towards the nose 42 and causes the first predetermined breaking line 44 to break forming an outlet slot 48 (see FIG. 6) between the nose 42 and the outer wall of the storage chamber 14. This outlet slot 48 then forms the outlet 34 of the storage chamber 14 and if a fluid ingredient is present in the storage chamber 14 this can then be output via this outlet slot 48. At its end 40 remote from the nose 42 the sealing part 36 forms a seal with an inner wall of the outlet part 32. Thereby an air tight storage chamber 14 is formed by the sealing part 36 and the outlet part 32.

A second predetermined breaking line 50 is present in the sealing part 36. This extends around the sealing part 36 and forms a venting slot 52 (see FIG. 6) between the end of the sealing part 36 engaging the nose 42 and the end of the sealing part 36 following an activation of the applicator 10. This venting slot 52 is provided such that airflow into the storage chamber 14 can be regulated, preferably by a valve 56 arranged in the venting system 54. The valve permits air flow into the storage chamber 14 to prevent a build-up of negative pressure in the proximal part of the storage chamber 14 in which no fluid ingredient is present, i.e. in an excess volume of the storage chamber 14. Preventing a build-up of negative pressure in the storage chamber 14 facilitates a dispensing of the fluid ingredient from the storage chamber 14.

The fluid ingredient 33 is stored in a distal part of the storage chamber 14. The distal part of the storage chamber 14 extends from the outlet 34 up to at most the location of the second predetermined breaking line 50. By providing the fluid ingredient 33 only in the distal part of the storage chamber 14 a flow of fluid ingredient 33 out of the venting slot 52 can be prevented.

A leak of the fluid ingredient 33 from the storage chamber 14 via the venting slot 52 can be prevented by dimensioning the storage chamber 14 and the venting slot 52 in such a way that a sufficient distance is maintained between the active ingredient 33 and the venting slot 52 regardless of in what spatial orientation the applicator 10 is located.

This can be achieved, on the one hand, by only filling the storage chamber 14 with a sufficiently small amount of fluid ingredient 33 and, on the other hand, by selecting the spacing between the venting slot 52 and the wall of the outlet part 32 disposed opposite the venting slot 52 so large, that in a storage state of the applicator 10, the fluid ingredient 33 can be stored in the storage chamber 14, preferably at the wall of the outlet part 32 disposed opposite the venting slot 52, without the fluid ingredient 33 actually coming into contact with the venting slot 52.

In addition to or as an alternative to the selection of an appropriate spacing between the venting slot 52 and the wall of the outlet part 32 disposed opposite the venting slot 52, the internal length of the storage chamber 14 between the venting slot 52 and the first predetermined breaking point or line 44 can be selected in such a way that, when the applicator 10 is positioned with the first predetermined breaking point or line 44 pointing downwardly (not shown), the fluid ingredient 33 stored in the storage chamber 14 does not reach a level that permits the fluid ingredient 33 to come into contact with the venting slot 52 or even a level that would cover the venting slot 52.

The venting slot 52 should preferably be arranged at the middle of the storage chamber 14, this means positioned as close to a longitudinal axis defining the longitudinal direction L of the applicator 10 as possible. In this way a maximum filling level of the applicator can be achieved in comparison to an arrangement of the venting slot 52 at the outer side of the storage chamber 14.

In order to output the fluid ingredient 33 from the storage chamber 14, the applicator 10 is positioned such that gravity can cause the flow of the fluid ingredient 33 out of the outlet 34, the venting system 54 preventing a build-up of negative pressure in the storage chamber 14.

The venting system 54 is integrated into an activation part 58 of the actuation mechanism 16. The venting system 54 comprises the venting channel 46 and the valve 56 formed in the activation part 58 (see also FIG. 4 with regard to the particulars of the venting system 54). The venting channel 46 actually comprises four separate venting channels 46 defined by a web 74 having an x-shaped cross-section (see also FIG. 4).

The activation part 58 has an outer thread 60 that engages an inner thread 62 of the outlet part 32 of the storage chamber 14 in order to bring about axial displacement of the venting system 54 and hence an activation of the first and second predetermined breaking lines 44, 50. The number of turns of the outer thread 60 determine the distance x (see FIG. 6) the venting system 54 can be displaced relative to the storage chamber 14 and also the distance which a part or section of the outlet part 32 and/or of the sealing part 36 can be displaced on an actuation of the applicator 10.

In this connection it should be noted that, on activation of the applicator 10, at least one section of the outlet part 32 and of the sealing part 36 is axially displaced. The at least one section of the outlet part 32 and of the sealing part 36 then being displaced relative to at least some of the other sections of the outlet part 32 and of the sealing part 36 that remain fixed in their original position.

Figure 4:
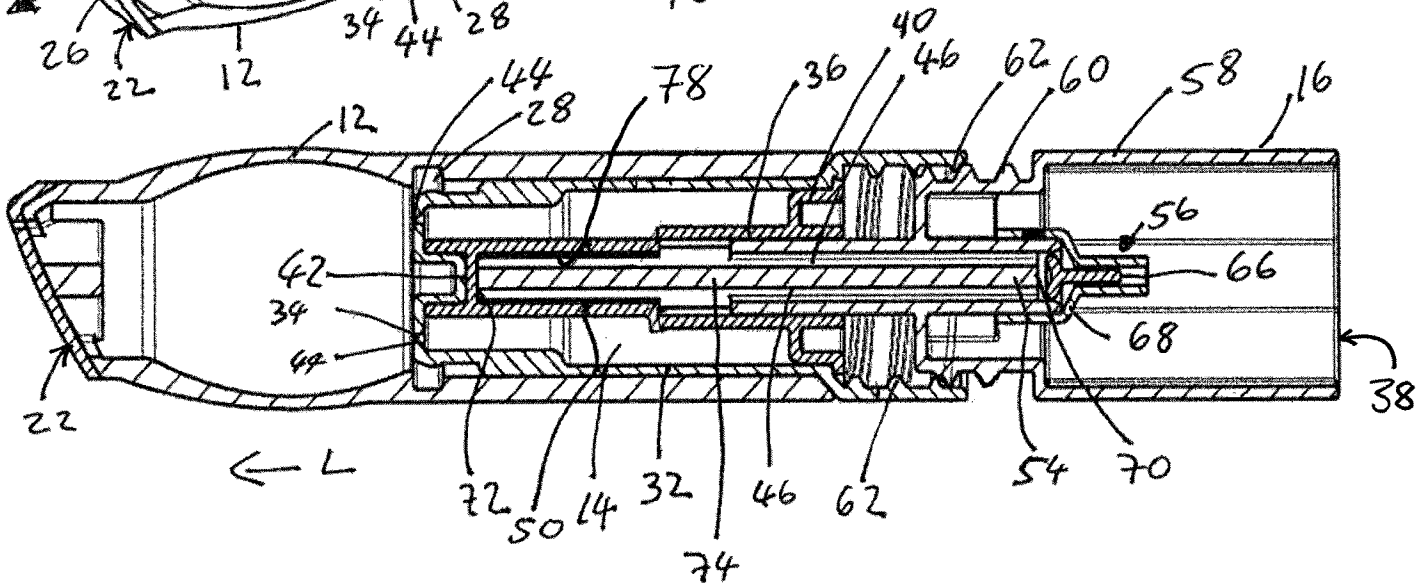
FIG. 4 is a schematic section of the storage chamber and of the venting system of the applicator of FIG. 3.

FIG. 4 shows a section of the storage chamber 14 and of the actuation mechanism 16 comprising the venting system 54. The venting system 54 comprises the valve 56 connected to the venting channel 46. The valve 56 permits a flow of air into the storage chamber 14 but prevents a flow of air from the storage chamber 14 out of the venting slot 52 (see FIG. 6) formed in the sealing part 36 on an activation of the applicator 10. The venting channel 46 is formed within the sealing part 36. The valve 56 comprises a valve plunger 66 cooperating with a valve seat 68 at a proximal end 70 of the venting channel 46 in order to control the flow of air.

In use the web 74 of the venting system 54 acts as a plunger 74 that is arranged within a channel 78 present in the sealing part 36 of the storage chamber 14. Moreover, the web 74 is arranged remote from the storage chamber 14, this means that in the storage position of the applicator 10 there can be no contact between substances present in the storage chamber 14 and the web 74. The web 74 is introduced into the sealing part 36 via the activation end 38.

On activation of the actuation mechanism 16, the web 74 is displaced within the channel 78 in the direction of the outlet 34. Thereby, a distal end 72 of the web 74 engages the sealing part 36 and thereby axially displaces the nose 42 of the outlet part 32 to activate the first predetermined breaking line 44 and also the second predetermined breaking line 50 by entraining the end of the sealing part 32 engaging the nose 42 in the direction of the axial displacement of the at least one part or section of the storage chamber 14.

The storage chamber 14 is arranged around the sealing part 36. In this way the web 74 acting as a plunger is axially guided through a central region of the storage chamber 14 on activation of the applicator 10.

It should also be noted that the web 74 is coupled to the venting system 54 which in turn is coupled to the actuation mechanism 16 in such a way that on activation of the actuation mechanism 16, the activation part 58 is moved such that it axially displaces the venting system 54 and thereby the web 74 such that this acts as a plunger to bring about an activation of the first pre-determined breaking line 44 and thereby to cause the sealing part 36 to be stretched to such an extent that the second pre-determined breaking line 50 present in the sealing part 36 is activated.

According to a further embodiment the web 74 can be formed integrally with the actuation mechanism 16, in particular with the activation part 58.

The venting system 54 can comprise at least one venting passage connecting the venting channel 46 to the inside of the activation part 58 and/or to the environment.

Figure 5:
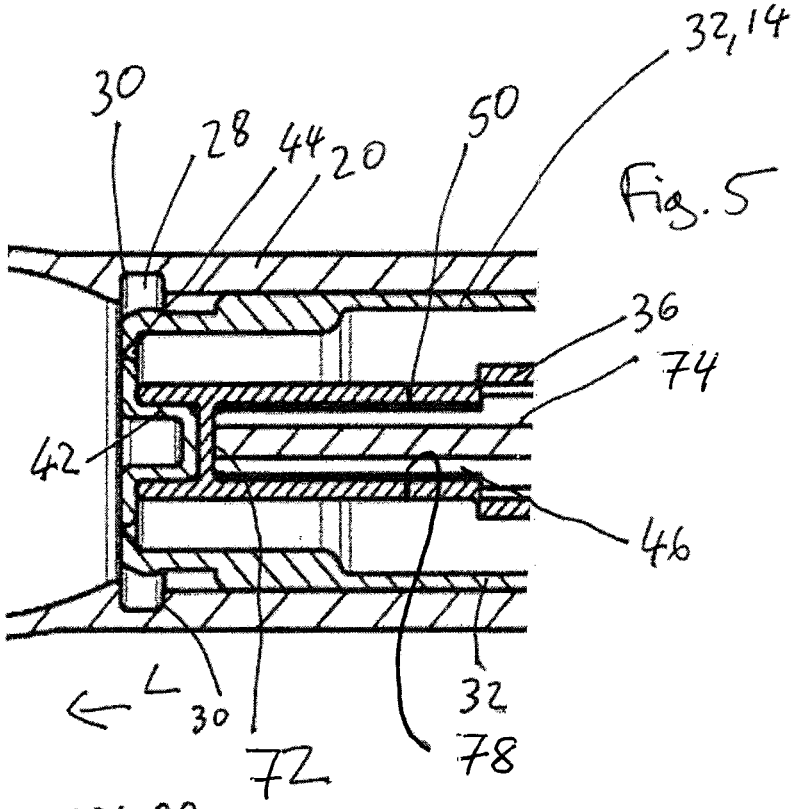
FIG. 5 is an enlarged section of the area A of FIG. 3 in a non-activated state.

FIG. 5 in a schematic section shows the region A of the storage chamber 14 of FIG. 3 in more detail. In particular FIG. 5 shows how the distal end 72 of the web 74 engages the sealing part 36 that engages the nose 42 of the outlet part 32. The venting channel 46 is axially displaced towards the nose 42 by the actuation mechanism 16 (see FIG. 4), so that the first and second breaking lines 44, 50 are activated. The first predetermined breaking point or line 44 forms a boundary between the section of the outlet part 32 comprising the nose 42 and a wall section of the outlet part 32 having the projection 28, with the boundary being broken on activation of the applicator 10.

Figure 6:
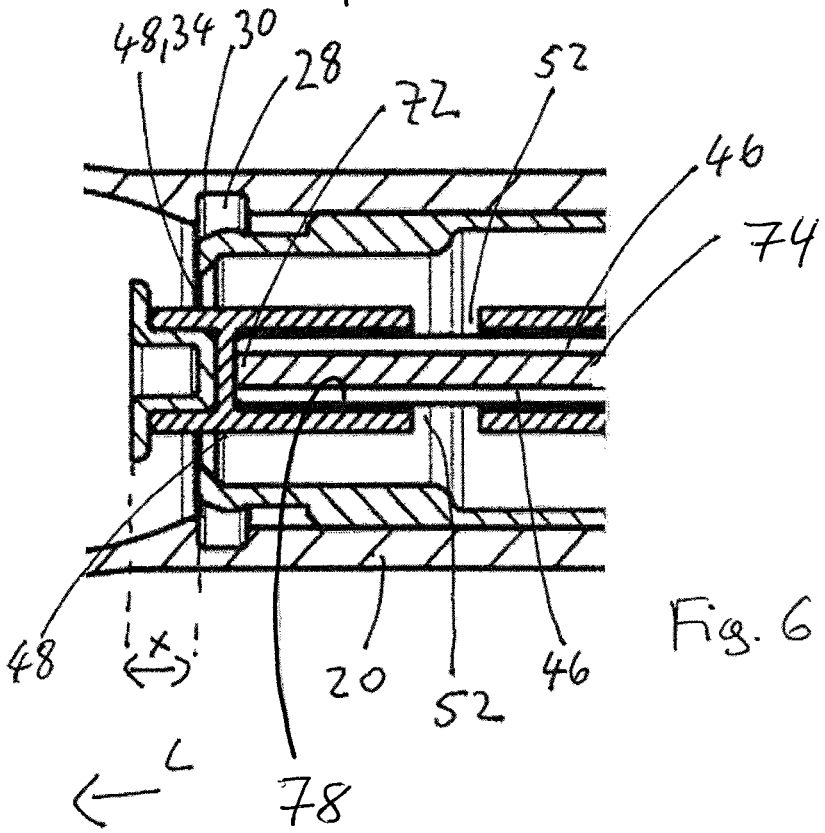
FIG. 6 is a view of the applicator of FIG. 5 in an activated state of the applicator.

FIG. 6 shows the situation once the first and second predetermined breaking lines 44, 50 have been broken in order to form the outlet slot 48 and the venting slot 52. The section of the outlet part 32 having the nose 42 formed therein has been displaced by a distance x. The distance x being predefined by the length the threaded section 60 of the activation part 58 can travel relative to the storage chamber 14 (see FIG. 4).

In order to retain the parts of the first and second predetermined breaking lines 44, 50 that may become detached a film hinge can be provided (not shown). However, it should be noted that designs naturally exist in which such a film hinge is not required. The film hinge is provided to prevent the section of the outlet part 32 having the nose 42 from being displaced so far into the application compartment 12 that the dispensing outlet 26 becomes blocked by this part.

The invention claimed is:

1. An applicator for a fluid ingredient, comprising:

at least one storage chamber, the storage chamber having an outlet end with an initially sealed outlet via which a fluid ingredient is capable of being output;

at least one first predetermined breaking point or line configured in or at the storage chamber; and an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator, the actuation mechanism actuated by at least one of a rotation of the at least one activation part and an axial movement of the at least one activation part, the actuation mechanism comprises a first threaded section configured to engage a second threaded section in the storage chamber to bring about both the rotation and the axial movement of the at least one activation part, upon the activation of the applicator, and the storage chamber comprises at least two parts, an outlet part comprising the outlet and a sealing part inserted into the outlet part via an activation end, with an end of the sealing part being remote from the outlet end and sealing off the storage chamber so as to provide an airtight storage chamber.

2. The applicator in accordance with claim 1, wherein the actuation mechanism includes a plunger, formed by a web, with the plunger configured to transmit a force induced by the at least one activation part to the at least one part or section of the storage chamber during axial displacement thereof, upon the activation of the applicator.

3. The applicator in accordance with claim 1, wherein the second threaded section is disposed in the outlet part.

4. The applicator in accordance with claim 3, wherein the actuation mechanism includes a plunger, formed by a web, with the plunger configured to transmit a force induced by the at least one activation part to the at least one part or section of the storage chamber during axial displacement thereof, upon the activation of the applicator, the plunger being received within the sealing part via the activation end within a channel formed within the sealing part, with the channel being formed within the storage chamber.

5. The applicator in accordance with claim 1, wherein the storage chamber is disposed between an inner surface of the outlet part and an outer surface of the sealing part, with the outer surface of the sealing part extending within the outlet part such that the storage chamber is of a tube-like design and is disposed around the sealing part that is likewise a tube-like design.

6. The applicator in accordance with claim 1, wherein the actuation mechanism includes a plunger, formed by a web, with the plunger configured to transmit a force induced by the at least one activation part to the at least one part or section of the storage chamber during axial displacement thereof, upon the activation of the applicator, the plunger being configured to engage the sealing part and thereby indirectly the outlet part in a distal region in which the sealing part and the outlet part contact one another to activate the at least one first predetermined breaking point or line upon the activation of the applicator.

7. The applicator in accordance with claim 6, wherein the distal region comprises a nose in the outlet part and the sealing part engages the nose of the outlet part.

8. The applicator in accordance with claim 1, further comprising an application compartment adjacent to the storage chamber and separate from the storage chamber in a storage state of the applicator, and the at least one first predetermined breaking point or line being arranged between the application compartment and the storage chamber, or the applicator further comprising a dispensing aid at a dispensing end of the applicator.

9. The applicator in accordance with claim 1, further comprising a fluid ingredient stored in the at least one storage chamber.

10. An applicator for a fluid ingredient, comprising:

at least one storage chamber, the storage chamber having an outlet end with an initially sealed outlet via which a fluid ingredient is capable of being output;

at least one first predetermined breaking point or line configured in or at the storage chamber;

a venting system;

an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator, the actuation mechanism including a plunger, formed by a web, with the plunger configured to transmit a force induced by the at least one activation part to the at least one part or section of the storage chamber during axial displacement thereof, upon the activation of the applicator, and the plunger being part of the venting system; and a sealing part configured to accommodate at least a part of the venting system.

11. An applicator for a fluid ingredient, comprising:

at least one storage chamber, the storage chamber having an outlet end with an initially sealed outlet via which a fluid ingredient is capable of being output;

at least one first predetermined breaking point or line configured in or at the storage chamber;

an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator; and a venting system, the venting system is-arranged at least in part within the storage chamber and comprises a venting channel.

12. An applicator for a fluid ingredient, comprising:

at least one storage chamber, the storage chamber having an outlet end with an initially sealed outlet via which a fluid ingredient is capable of being output;

at least one first predetermined breaking point or line configured in or at the storage chamber;

an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator; and a venting system, the venting system comprising a valve configured to control a flow of gas into the storage chamber.

13. An applicator for a fluid ingredient, comprising:

at least one storage chamber, the storage chamber having an outlet end with an initially sealed outlet via which a fluid ingredient is capable of being output;

at least one first predetermined breaking point or line configured in or at the storage chamber;

an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator; and a venting system, at least one second predetermined breaking point or line being arranged between the venting system and the storage chamber.

14. The applicator in accordance with claim 13, wherein, upon the activation of the applicator, the actuation mechanism axially displaces the venting system and activates at least the first and second predetermined breaking points or lines, with the at least one first predetermined breaking point or line being configured in the outlet part and the at least one second predetermined breaking point or line being arranged at the sealing part.

15. The applicator in accordance with claim 13, further comprising catching elements that retain parts of at least one of the first and second predetermined breaking point or line after activation of the applicator.

16. An applicator for a fluid ingredient, comprising:

at least one storage chamber, the storage chamber having an outlet end with an initially sealed outlet via which a fluid ingredient is capable of being output;

at least one first predetermined breaking point or line configured in or at the storage chamber; and an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator, the actuation mechanism comprising a venting system and the venting system being displaced within the storage chamber upon the activation of the applicator.

17. A method of activating an applicator filled with a fluid ingredient, the method comprising:

providing the applicator, the applicator including at least one storage chamber, the storage chamber having an outlet end with an initially sealed outlet via which a fluid ingredient is capable of being output, at least one first predetermined breaking point or line configured in or at the storage chamber, an actuation mechanism arranged at the storage chamber, the actuation mechanism having at least one activation part capable of being displaced relative to the outlet end and by which at least one part or section of the storage chamber is capable of being axially displaced to activate the at least one first predetermined breaking point or line, upon activation of the applicator, and a venting system, at least one second predetermined breaking point or line being arranged between the venting system and the storage chamber; and displacing the at least one activation part relative to a dispensing end, thereby breaking the at least one first predetermined breaking point or the at least one second predetermined breaking point through an axial displacement of at least a part of the storage chamber.

* * * * *